United States Patent [19]

Mista

[11] 4,195,789

[45] Apr. 1, 1980

[54] BOBBIN SLIDES FOR RESPOOLING MACHINES

[75] Inventor: Kresimir Mista, Obertshausen, Fed. Rep. of Germany

[73] Assignee: Karl Mayer Textilmaschinenfabrik GmbH, Oberthausen, Fed. Rep. of Germany

[21] Appl. No.: 934,056

[22] Filed: Aug. 15, 1978

[30] Foreign Application Priority Data

Aug. 17, 1978 [DE] Fed. Rep. of Germany ..... 2836978

[51] Int. Cl.[2] ..... B65H 54/20; B65H 67/02

[52] U.S. Cl. ..... 242/35.5 A; 242/35.6 R

[58] Field of Search ..... 242/35.6 R, 35.5 R, 242/35.5 A, 18 R, 129.5, 129.7, 129.71, 130

[56] References Cited

U.S. PATENT DOCUMENTS 2,177,763 10/1939 Abbott et al. ..... 242/35.6 R

*Primary Examiner*—Stanley N. Gilreath

*Attorney, Agent, or Firm*—Omri M. Behr

[57] ABSTRACT

A bobbin slide for automatically guiding a bobbin on a thread respooling machine includes an elongated generally U-shaped housing which is pivoted about a horizontal axis at one end thereof. The other end of the housing is provided with a sloped portion disposed proximate a take-up finger which is adapted to receive the bobbin. A spring bias means is coupled to the housing at one end for urging the housing sloped portion towards the take-up finger. The weight of the bobbin on the housing causes the housing to move away from the take-up finger permitting the finger to enter the opening in the bobbin and thereby position it for use.

8 Claims, 5 Drawing Figures

BOBBIN SLIDES FOR RESPOOLING MACHINES

BACKGROUND OF THE INVENTION

1. Field of the Invention

The present invention relates to a means for automatically positioning bobbins, and in particular, relates to a bobbin slide for automatically guiding a bobbin onto the take-up finger on a thread respooling machine.

2. Description of the Prior Art

Bobbins of many different sizes are in use today. These bobbins include spools onto which various types of thread are wound. Respooling machines are utilized to rewind thread from either larger or smaller storage or holding devices onto larger more uniform spools for use in a knitting machine. In using the knitting machine to manufacture different types of material, different threads are utilized and, consequently, different spool diameters may also be utilized. Relatively small bobbins, which may vary in external diameter as well as have different spool sizes, are utilized in a respooling machine which provides a larger uniform bobbin, that contains greater amounts of thread on a generally smaller diameter spool. The larger bobbin enables the knitting machines to operate for longer periods of time without interruption.

The problem of accepting the smaller bobbins, which have different spool diameters, into the respooling machine has been known for a long time. If the smaller bobbin is not received on the take-up finger when required, the respooling machine is required to be shut down until operating personnel can realign the bobbin, resulting in shut-down time and unnecessary additional personnel.

Prior art systems utilized the weight of the bobbin to press against an eccentric setting cam which was specifically pre-set in accordance with the bobbin size. This, of course, was done by an individual who reset the machine each time and in turn required manpower to keep watch on the machine. Where many machines were utilized, it led to unnecessary additional personnel and downtime.

Other prior art devices utilized a slide comprising an axially bisected funnel which required adjustment by personnel and the synchronization of both sections of the funnel that required still further mechanical devices.

The present invention overcomes the shortcomings of the prior art by providing a freely rotatable bobbin slide which is spring biased in the direction of the take-up finger. Contact between the take-up finger and the slide may be prevented by utilizing an adjustable stop. Both the spring tension and the stop may be adjusted to an optimum position thereby preventing shutdowns once the machinery has been started since the bobbin is always received on the take-up finger in proper alignment.

A bobbin slide, according to the principles of the present invention, for automatically guiding a bobbin on a thread respooling machine comprises, in combination, an elongated generally U-shaped housing, a take-up finger and a spring bias means. The housing is pivotable about a horizontal axis at one end thereof, the other end is provided with a sloped portion. The take-up finger is disposed proximate to the sloped portion of the housing that is adapted to receive the bobbin. The spring bias means is coupled to the housing at one end and urges the housing's sloped portion toward the take-up finger. A stop means is provided for preventing the sloped portion of the housing from contacting the take-up lever.

BRIEF DESCRIPTION OF THE DRAWINGS

In order that the invention may be more fully understood, it will now be described, by way of example, with reference to the accompanying drawing in which.

DESCRIPTION OF THE PREFERRED EMBODIMENT

Figure 1A:
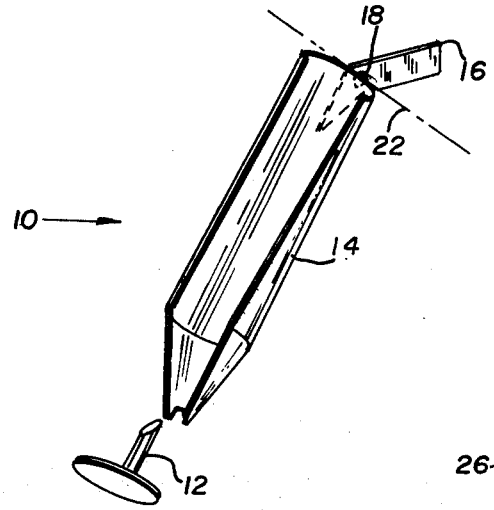
FIG. 1A is an isometric view of the bobbin slide and take-up finger shown in FIG. 1.
Figure 1:
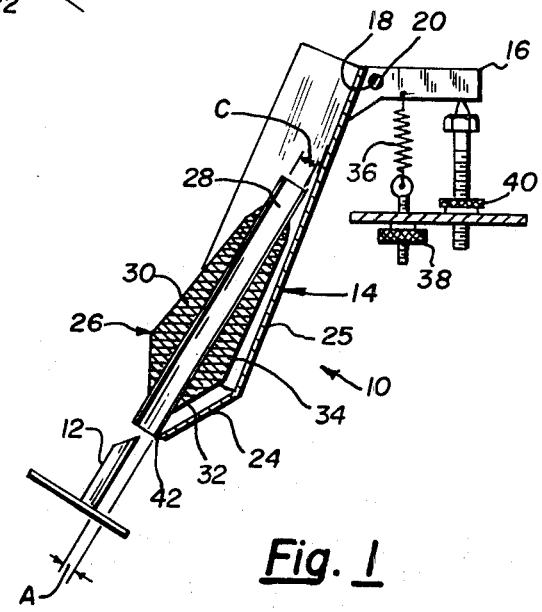
FIG. 1 is a cross-sectional view of a bobbin disposed upon a slide just prior to engagement with the take-up finger, according to the principles of the present invention.

Referring now to the figures, and in particular to FIGS. 1 and 1A, there is shown a bobbin slide 10 which includes a take-up finger 12 and an elongated generally U-shaped housing 14. The housing 14 is provided at one end with an outwardly extending arm 16 which is affixed to the housing 14 in a conventional manner. The arm 16 is provided with an aperture 18 which is adapted to receive a pin or rod 20 which functions as a pivotal horizontal axis 22 permitting the housing 14 to rotate thereabout. The other end 24 of housing 14 is provided with a sloped portion adapted to receive a bobbin 26 thereon. The bobbin 26 includes a spool 28 which has a plurality of thread layers 30 wound thereon. The downwardly falling bobbin 26 will be received by the take-up finger 12 if there is proper alignment.

The angle between the sloped portion 24 of the slide and the straight portion 25 is designated phi ($\phi$). The lower surface 32 of the thread 30 spun on the bobbin forms an angle with the thread surface 34 substantially parallel with the spool axis. The angle between 32 and 34 is designated phi prime ($\phi'$) and is generally referred to as the spin on angle.

In the preferred embodiments the angle phi ($\phi$) is set to be equal to or smaller than the spin on angle phi prime ($\phi'$).

The arm 16 of housing 14 has coupled thereto an adjustable spring 36 whose tension may be modified by the rotation of knurled nut 38, in a conventional manner. The resting position of housing 14 is determined by the stop 40, since spring 36 pulls arm 16 in a downwardly direction until it comes to rest when contacting the stop 40. Thus, in the rest position the edge 42 is adjusted in a conventional manner, by means of a nurled knob 40 so that the distance A between the take-up finger 12 and the lower edge 42 is equal to or smaller than the internal diameter of the smallest spool 28 to be utilized. A is also made equal to or greater than the largest thickness B of the spool to be utilized. In other words, the inner diameter C of the spool 28 is preferably greater than the distance A and greater than the thickness B.

Figure 2:
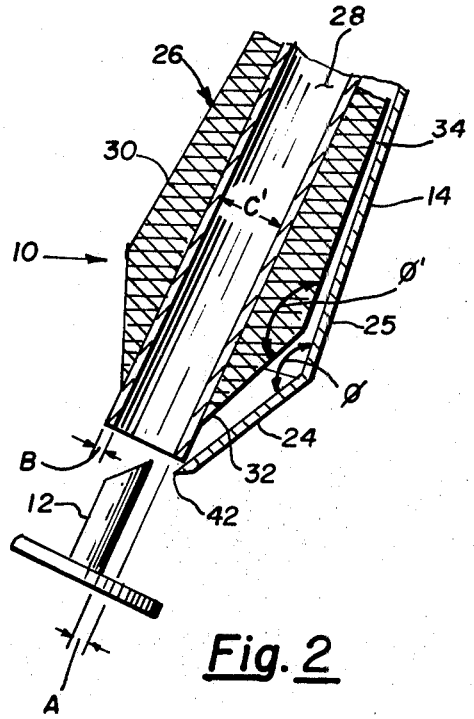
FIG. 2 is an enlarged cross-sectional view of a oversized bobbin just prior to entry upon the take-up finger.

FIG. 2 illustrates how, if the above specified constraints are adhered to, the spool 26, although having a different dimension C' for the internal spool diameter, will properly seat on the take-up finger 12 when the housing 14 is deflected by the weight of the spool 26.

Figure 3:
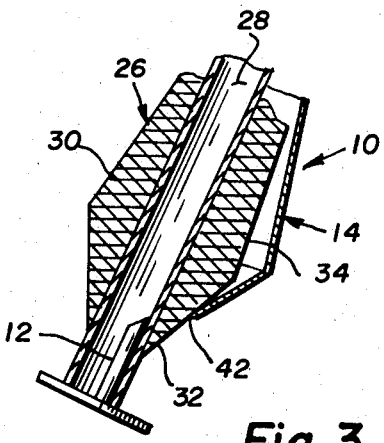
FIG. 3 is an enlarged cross-sectional view of the bobbin shown in FIG. 2 after seating upon the take-up finger.

FIG. 3 shows the spool 26 seated upon the take-up finger 12 once the weight of the spool 26 has caused the housing 14 to be deflected. The action of spring 36 (see FIG. 1) causes the edge 42 of housing 14 to align the inner spool wall with the take-up finger 12.

Figure 4:
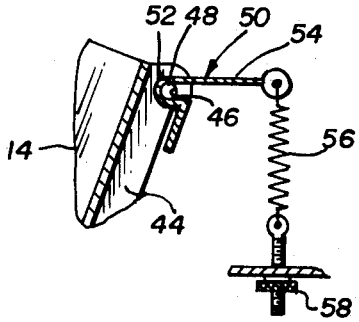
FIG. 4 is an enlarged partial view of an alternate embodiment of the pivotal portion of a bobbin slide.

In the alternate embodiment disclosed in FIG. 4 a protrusion 44 is provided proximate to one end of the housing 14. An aperture 46 is adapted to receive a rod 48 therein which provides a horizontal transverse axis about which the housing 14 may be rotated. A bracket 50 is provided with a rounded portion 52 which partially circumscribes rod 48 and then extends outwardly therefrom, essentially perpendicular to a horizontal elongated portion 54. The edge of the elongated portion 54 is provided with a means for coupling an adjustable biasing spring 56 thereto in a manner similar to that disclosed in the embodiment shown in FIG. 1. An adjustment nut 58 is provided to control the position of bracket 50 by increasing the tension on spring 56 to permit the downwardly extending portion of bracket 50 to come into contact with the protrusion 44 provided on the housing 14. Thus, exerting pressure by increasing the tension on spring 56 causes the downwardly extended portion of bracket 50 to urge the housing 14 in an upwardly direction until the portion 54 of bracket 50 comes into contact with a stop 40 as is shown in FIG. 1, thereby positioning the housing 14 proximate the take-up finger 12. The adjustable stop 40 would normally be positioned between rod 48 and the spring end of bracket 50 but has not been shown to more clearly disclose the configuration of this embodiment. The operation of the embodiment disclosed in FIG. 4 is the same as that shown in FIG. 1.

Hereinbefore it has been disclosed a bobbin slide for automatically guiding a bobbin on a thread respooling machine which insured the accurate positioning of a spool on a take-up finger. It will be understood that various changes in the details, materials, arrangement in parts and operating conditions which have been herein described and illustrated in order to explain the nature of the invention may be made by those skilled in the art within the principles and scope of the invention.

Having thus set forth the nature of the invention, what is clamed is:

1. A bobbin slide for automatically guiding a bobbin on a thread respooling machine comprises, in combination:

(a) an elongated generally U-shaped housing, said housing being pivotable about a horizontal axis at one end thereof, the other end being provided with a sloped portion;

(b) a take-up finger, said finger being disposed proximate to the sloped portion and adapted to receive said bobbin;

(c) spring bias means coupled to said housing one end for urging said housing sloped portion towards said take-up finger; and (d) adjustable stop means for preventing said sloped portion of said housing from contacting said take-up finger by adjusting the distance from the edge of said sloped portion of said housing to said take-up finger.

2. A bobbin slide according to claim 1 wherein when said slide is in contact with said stop means the distance from the edge of said sloped portion to said take-up finger is less than the internal diameter of the smallest bobbin spool utilized.

3. A bobbin slide according to claim 1 wherein when said slide is in contact with said stop means the distance from the edge of said sloped portion to said takeup finger is greater than the wall thickness of the largest bobbin spool utilized.

4. A bobbin slide according to claim 1 wherein said sloped portion is sloped at an angle phi ($\phi$) which is equal to the largest spin-on angle phi prime ($\phi'$) of the bobbin.

5. A bobbin slide according to claim 1 wherein said sloped portion is sloped at an angle phi ($\phi$) which is smaller than the largest spin-on angle phi prime ($\phi'$) of the bobbin.

6. A bobbin slide according to claim 2 or 3 wherein said distance from the edge of said sloped portion to said take-up finger is adjustable.

7. A bobbin slide according to claim 1 wherein said spring bias means is adjustable.

8. A bobbin slide according to claim 1 wherein said pivotal axis is provided by a rod extending through an aperture provided in an outwardly extending protrusion proximate said housing one end.

* * * * *